United States Patent [19]

Ashrow

[11] Patent Number: 4,524,711

[45] Date of Patent: Jun. 25, 1985

[54] SWIMMING HARNESS

[76] Inventor: David P. Ashrow, 1651 N. Foothill Rd., Ojai, Calif. 93023

[21] Appl. No.: 512,665

[22] Filed: Jul. 11, 1983

[51] Int. Cl.[3] ..... F16G 11/00

[52] U.S. Cl. ..... 114/215; 441/55; 441/84; 272/71; 267/74

[58] Field of Search ..... 114/205, 213, 215, 230, 114/247, 251; 87/2, 8, 9; 289/1.2, 1.5, 2, 16.5, 18.1; 267/69, 74, 148; 272/71, 142; 441/84, 55

[56] References Cited

U.S. PATENT DOCUMENTS

| | | | |
|---|---|---|---|
| 2,700,317 | 1/1955 | Lilienfeld | 87/8 |
| 2,878,013 | 3/1959 | Piodi | 114/213 |
| 3,078,755 | 2/1963 | Chace | 87/9 |
| 3,126,860 | 3/1964 | Shepperton | 114/230 |
| 3,127,019 | 3/1964 | Von Meyer | 211/119.13 |
| 4,247,096 | 1/1981 | Schmitt | 272/71 |

FOREIGN PATENT DOCUMENTS

| | | | |
|---|---|---|---|
| 2303694 | 8/1974 | Fed. Rep. of Germany | 272/71 |

OTHER PUBLICATIONS

Hans Sickinger Co., Exerswim, Pontiac, Michigan, 1976.

*Primary Examiner*—Trygve M. Blix
*Assistant Examiner*—Stephen P. Avila
*Attorney, Agent, or Firm*—Jack C. Munro

[57] ABSTRACT

A swimming harness for holding a swimmer at a selected location in a swimming pool, yet giving the swimmer freedom of swimming movement. The swimming harness comprises an elongated member, the inner end of which is attached to a fixed exterior object and the outer end of which is connected to a belt which is to be located about the waist of the swimmer. A resilient section is located between the inner and outer ends of the members to provide a limited amount of stretching movement.

2 Claims, 5 Drawing Figures

SWIMMING HARNESS

BACKGROUND OF THE INVENTION

The field of this invention relates to the sport of swimming, and more particularly to a swimming exercise device in which the swimmer is free to swim within a confined area of a swimming pool.

Normally, if an individual desires to exercise by swimming, a certain sized swimming pool is necessary. Normally any swimming pool less than twenty-five feet in length is difficult for one to perform any kind of regular exercise program. Swimming pool lengths of thirty-five to fifty feet are actually preferred.

Therefore, if an individual desires to swim for exercise, then that individual must normally have access to a significantly sized swimming pool. It is normally desirable that this access be convenient. Swimmers normally like to swim for exercise at unusual hours. Therefore, in order for a swimming pool to be convenient, the pool will have to be located very close, or on the premises of the swimmer's home.

However, to construct swimming pools of a size great enough to facilitate exercise is a significant expense. Also, such swimming pools take up a substantial amount of space. Many times it is just not feasible to construct a swimming pool to be this large in size. Many times even the premises of one's home does not have sufficient yard area to accommodate even a twenty-five foot in length swimming pool. Additionally, condominium associations would much rather install two or three small swimming pools which are spread out through the condominium development rather than one single larger sized swimming pool.

Additionally, there are other pool installations in which the constructing of a larger sized pool is not feasible. For example, on a cruise ship there may be two or three different swimming pools on different decks of the ship. However, each of the swimming pools are not of a sufficient size to encourage an active exercise program by a single swimmer. Also, since these swimming pools are frequently crowded, it is not feasible to use the swimming pool for exercise.

However, if some means could be devised which could hold the swimmer within a small area of a small sized swimming pool and give the swimmer freedom of movement to swim, then an individual could exercise by swimming within almost any size of swimming pool.

SUMMARY OF THE INVENTION

The structure of the present invention relates to a harness which comprises an elongated member, such as a nylon cord. Between the ends of the elongated member, the nyon cord is formed into a mass of knots thereby obtaining a certain amount of limited stretch of the member. The inner end of the nylon cord is to be attached as by tying or other conventional fastening means to a fixed exterior object. The outer end of the cord is connected to a belt. The belt is to be located about the waist of the swimmer. The limited amount of stretching of the cord is necessary so as to counteract the forces that are produced by the swimmer during the swimming motion.

The primary objective of the present invention is to construct a device which can be used by a swimmer where the swimmer can exercise by swimming within a small area of a swimming pool.

Another objective of the present invention is to construct a device which can be manufactured inexpensively and is small in size and low in weight and can therefore be readily carried by the individual to a particular desired location.

Another objective of this invention is to construct a device which does not require any special attachment to the swimmer and can be easily connected to a swimmer and function satisfactorily to hold the swimmer in a desired position during usage.

DETAILED DESCRIPTION OF THE SHOWN EMBODIMENT

Figure 1:
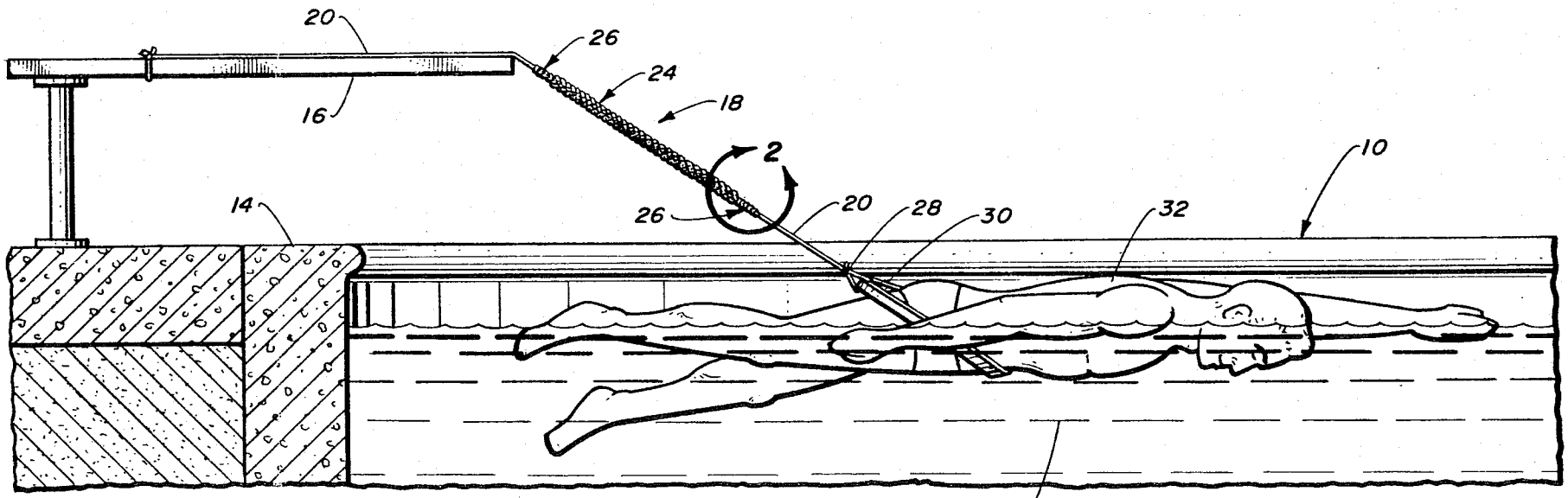
FIG. 1 is a side, elevational view, partly in cross-section, of a swimming pool showing a swimmer who is connected to the swimming harness of the present invention.
Figure 4:
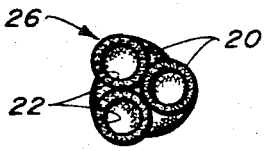
FIG. 4 is a cross-sectional view taken through the woven section of the swimming harness of the present invention which connects the cord to the knotted section taken along line 4—4 of FIG. 2.
Figure 5:
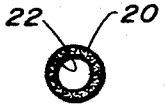
FIG. 5 is a cross-sectional view through the cord taken along line 5—5 of FIG. 2.
Figure 3:
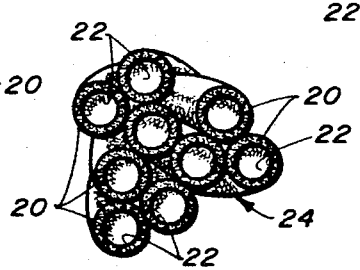
FIG. 3 is a cross-sectional view through the knotted section of the swimming harness of the present invention taken along line 3—3 of FIG. 2.
Figure 2:
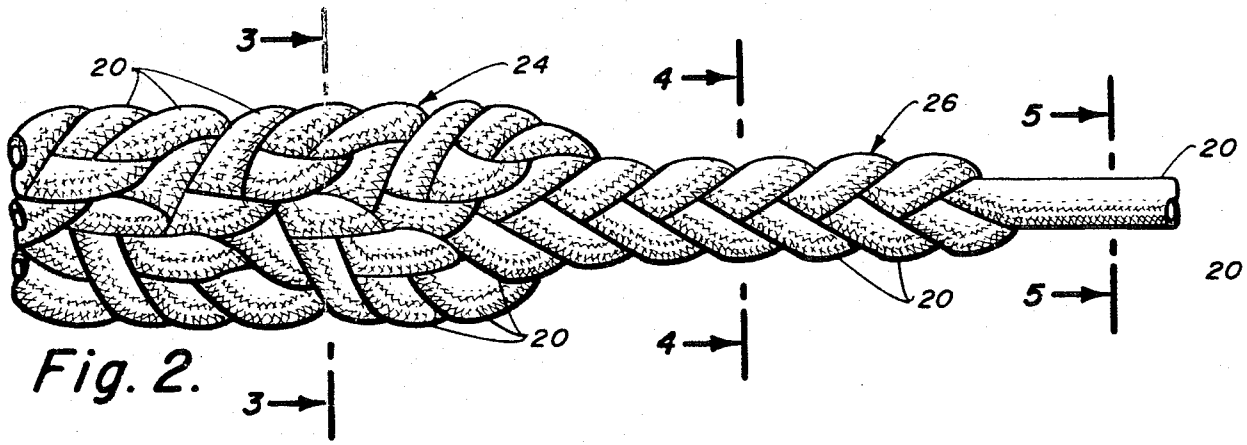
FIG. 2 is an enlarged view of a portion of the swimming harness of this invention taken along line 2—2 of FIG. 1.

Referring particularly to the drawing, there is shown conventional swimming pool 10 which contains water 12 and has a conventional decking 14. Mounted on the decking 14 is a diving board 16. The inner end of the harness 18 of the present invention is shown secured to the diving board 16. It is to be understood that the inner end of the harness could be attached to any other fixed object located in close proximity to the swimming pool 10.

The harness 18 is composed of an integral length of nylon cord 20. This cord 20 is deemed to be conventional and is constructed to be tubular forming an internal chamber 22. The weave of the cord is such that when the cord is stretched, the cord will slightly collapse making the internal chamber 22 slightly smaller.

In order to obtain additional stretch, it is desirable to form a knotted section 24. The knots 24 are formed by merely knotting an extended section of the cord 20. The particular knotting configuration is not important as any desirable knotting configuration will be sufficient. Actually, it is envisioned that other stretchable members could be utilized, such as a rubberized member, or possibly even some type of a spring.

Each end of the knotted section 24 is connected to a smaller diametered section forming a weave section 26. Each weave section 26 then terminates in a single strand of the cord 20. The weave section 26 is necessary to make the transistion from the enlarged knotted section 24 and the single strand cord 20 at each end of the knotted section 24.

The outer end of the cord 20 is formed into a loop 28. A belt 30 is passed through the loop 28. The belt 30 will normally be constructed of a conventional material, such as leather, plastic, rubber, or the like. The belt 30 will normally include a belt buckle (not shown). The belt 30 is to be loosely located about the waist of the swimmer 32, as is shown in FIG. 1 of the drawings.

During usage of the harness of this invention, as is shown in FIG. 1 of the drawings, the force produced by the swimmer 32 is damped by the resiliency of the knotted section 24. The damping of the force is so that with each stroke that the swimmer makes, the swimmer is not "jerked" back tending to push the swimmer below the surface of the water.

What is claimed is:

1. A swimming harness for holding a swimmer in a selected location in a swimming pool yet giving the swimmer freedom of swimming movement, said swimming harness comprising:

an elongated integral member having an inner end and an outer end, said elongated member being tubular defining an internal chamber, said elongated member comprising a cord, said elongated member including resilient means to permit a limited amount of stretching said elongated member, said resilient means comprising a mass of knots formed within said cord as well as the partial collapsing of said internal chamber during stretching of said cord, said mass of knots comprise a plurality of overlapping knots which are loosely knotted, said inner end adapted to be attached to an exterior fixed object; and a belt adapted to be located about the waist of the swimmer, said belt being attached to said outer end.

2. The swimming harness as defined in claim 1 wherein:

said belt being loosely located about the waist of the swimmer and held in position only by frictional movement.

* * * * *